US010795276B1

(12) United States Patent
Rokutan et al.

(10) Patent No.: US 10,795,276 B1
(45) Date of Patent: Oct. 6, 2020

(54) CONDUCTIVE ROLLER, TRANSFER DEVICE, PROCESS CARTRIDGE, IMAGE FORMING APPARATUS, AND METHOD FOR PRODUCING CONDUCTIVE ROLLER

(71) Applicant: FUJI XEROX CO., LTD., Tokyo (JP)

(72) Inventors: Minoru Rokutan, Kanagawa (JP); Kenta Shingu, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/774,198

(22) Filed: Jan. 28, 2020

(30) Foreign Application Priority Data

Sep. 18, 2019 (JP) ..... 2019-169713

(51) Int. Cl.

| | |
|---|---|
| ***G03G 15/02*** | (2006.01) |
| ***G03G 21/18*** | (2006.01) |
| ***G03G 15/08*** | (2006.01) |
| ***G03G 15/16*** | (2006.01) |
| ***G03G 21/00*** | (2006.01) |

(52) U.S. Cl.
CPC ..... *G03G 15/0233* (2013.01); *G03G 15/0216* (2013.01); *G03G 15/0808* (2013.01); *G03G 15/0818* (2013.01); *G03G 15/162* (2013.01); *G03G 15/1685* (2013.01); *G03G 21/0058* (2013.01); *G03G 21/1814* (2013.01); *G03G 2215/0858* (2013.01); *G03G 2215/0861* (2013.01); *G03G 2215/0863* (2013.01)

(58) Field of Classification Search
CPC ..... G03G 15/0216; G03G 15/0233; G03G 15/0808; G03G 15/0818; G03G 15/162; G03G 15/1685; G03G 21/0058; G03G 21/1814; G03G 2215/0858; G03G 2215/0861; G03G 2215/0863
See application file for complete search history.

(56) References Cited

U.S. PATENT DOCUMENTS

2008/0008503 A1* 1/2008 Imamura ..... G03G 15/0928 399/276
2018/0231907 A1* 8/2018 Kinuta ..... G03G 15/0233

FOREIGN PATENT DOCUMENTS

JP 2959445 B2 10/1999
JP 6364333 B2 7/2018

* cited by examiner

*Primary Examiner* — Joseph S Wong
(74) *Attorney, Agent, or Firm* — Sughrue Mion, PLLC

(57) ABSTRACT

A conductive roller includes a supporting member and a conductive elastic foam layer disposed on the supporting member. In a spectrum of amplitude (μm) vs. period (μm) obtained by subjecting a roughness waveform of the outer circumferential surface of the conductive elastic foam layer in an axial direction to fast Fourier transformation, the integrated value St of the amplitude within a period range of 100 μm or more and 300 μm or less is 455 μm or less.

16 Claims, 4 Drawing Sheets

CONDUCTIVE ROLLER, TRANSFER DEVICE, PROCESS CARTRIDGE, IMAGE FORMING APPARATUS, AND METHOD FOR PRODUCING CONDUCTIVE ROLLER

CROSS-REFERENCE TO RELATED APPLICATIONS

This application is based on and claims priority under 35 USC 119 from Japanese Patent Application No. 2019-169713 filed Sep. 18, 2019.

BACKGROUND

(i) Technical Field

The present disclosure relates to a conductive roller, a transfer device, a process cartridge, an image forming apparatus, and a method for producing a conductive roller.

(ii) Related Art

Japanese Patent No. 2959445 discloses a developing roller. The developing roller has hair-like fine roughness in which protrusions incline in a circumferential direction. The height of the roughness is 0.1 to 30 μm. The average distance between protrusions in a circumferential direction is 1 to 200 μm. The roughness forms wave stripes on the roller surface in an axial direction. JIS ten-point average roughness Rz of the roller surface in a circumferential direction is 5 to 20 μm, and JIS ten-point average roughness Rz in an axial direction is 3 to 15 μm. The average roughness Rz in a circumferential direction is more than the average roughness Rz in an axial direction.

Japanese Patent No. 6364333 discloses a developer supplying roller with a surface made of a polymeric foam material containing an ether-based urethane foam. The surface of the developer supplying roller has a surface roughness of 40 μm or more and 140 μm or less. Herein, the surface roughness refers to the standard deviation of displacement of 40 measuring points from a reference line. The measurement is performed across 40 mm, and the 40 measuring points are separated from each other by 1 mm.

SUMMARY

Aspects of non-limiting embodiments of the present disclosure relate to a conductive roller having a conductive elastic foam layer as the outermost layer. When a voltage is applied, the conductive roller is more unlikely to cause unusual discharge between the roller and a member facing the roller than a conductive roller that has an integrated value St of amplitude of more than 455 μm within a period range of 100 μm or more and 300 μm or less, or that has an amplitude $A_{300}$ of period 300 μm of more than 3.6 μm, in a spectrum of amplitude (μm) vs. period (μm) obtained by subjecting the roughness waveform of the outer circumferential surface of a conductive elastic foam layer in an axial direction to fast Fourier transformation.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a conductive roller including a supporting member and a conductive elastic foam layer disposed on the supporting member, wherein, in a spectrum of amplitude (μm) vs. period (μm) obtained by subjecting a roughness waveform of the outer circumferential surface of the conductive elastic foam layer in an axial direction to fast Fourier transformation, the integrated value St of the amplitude within a period range of 100 μm or more and 300 μm or less is 455 μm or less.

BRIEF DESCRIPTION OF THE DRAWINGS

Exemplary embodiments of the present disclosure will be described in detail based on the following figures, wherein.

DETAILED DESCRIPTION

Figure 1:
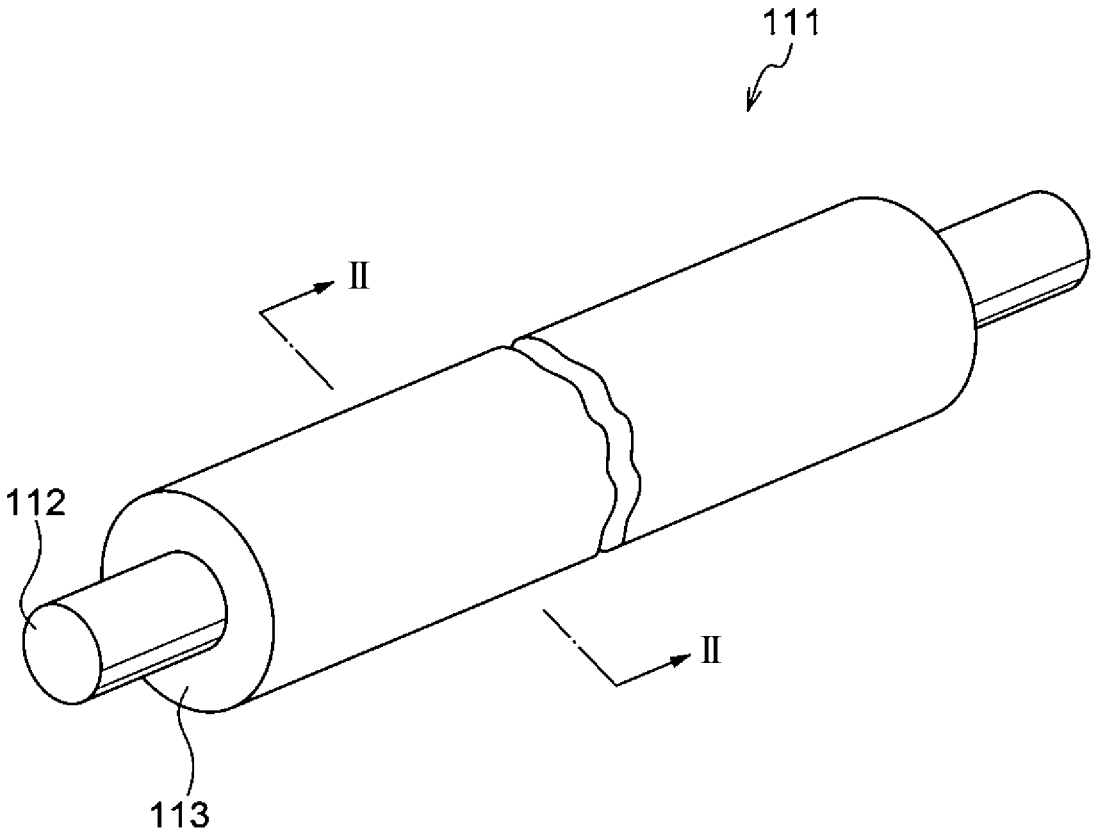
FIG. 1 is a schematic perspective view of an exemplary conductive roller according to the present exemplary embodiment.

Hereinafter, exemplary embodiments of the present disclosure will be described. Such description and examples describe the exemplary embodiments and do not limit the scope of the exemplary embodiments.

In the present disclosure, a numeral range with "to" refers to a range including the numeral value before "to" as the smallest value and the numeral value after "to" as the largest value.

When numerical ranges are described stepwise in the present disclosure, the upper limit or lower limit values of a numerical range may be replaced with the upper limit or lower limit values of another stepwise numerical range. The upper limit or lower limit values of a numerical range in the present disclosure may be replaced with a value in examples.

The word "step" in the present disclosure refers not only to an independent step, but also to a step that is not clearly separable from another step, provided that a predetermined object of the step is achieved.

When the exemplary embodiments are described with reference to the drawings in the present disclosure, structures in the exemplary embodiments are not limited to the structures in the drawings. The size of members in the drawings is conceptual, and thus the relative relation of the sizes of the members is not limited to the relative relations in the drawings.

In the present disclosure, each component may contain plural substances corresponding thereto. In the present disclosure, when a composition contains plural substances corresponding to a component thereof, the amount of component in the composition refers to the total amount of plural substances in the composition, unless stated otherwise.

In the present disclosure, a composition may contain plural powders corresponding to a component. When a composition contains plural powders corresponding to a component thereof, the particle size of the component refers to the particle size of the mixture of the plural powders in the composition, unless stated otherwise.

Conductive Roller

A conductive roller according to the present exemplary embodiment is suitably used as a roller of an electrophotographic image forming apparatus, such as a transfer roller, a developing roller, a charging roller, or an image-holder cleaning roller. Use of the conductive roller according to the present exemplary embodiment is not limited to the above rollers.

The conductive roller according to the present exemplary embodiment will be described with reference to the drawings.

Figure 2:
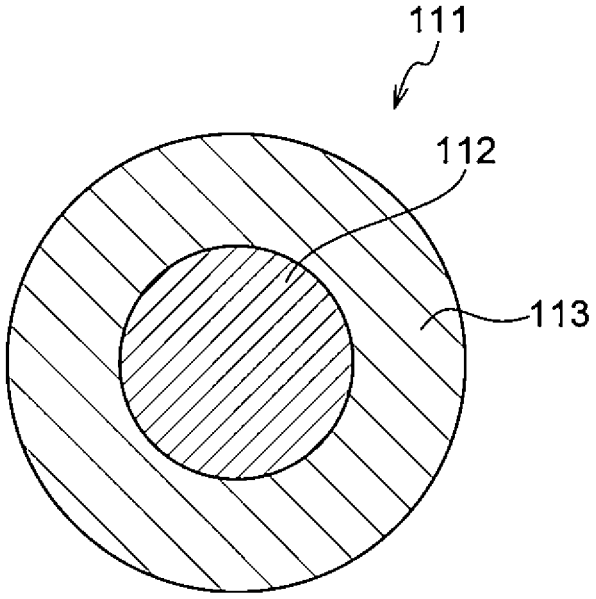
FIG. 2 is a schematic cross-sectional view of an exemplary conductive roller according to the present exemplary embodiment, taken along the line II-II of FIG. 1.

FIG. 1 is a schematic perspective view of an exemplary conductive roller according to the present exemplary embodiment. FIG. 2 is a cross-sectional view of the conductive roller taken along the line II-II of FIG. 1, in other words, a cross-sectional view of the conductive roller in FIG. 1 in a radial direction.

As illustrated in FIG. 1 and FIG. 2, a conductive roller 111 is a roller member including a hollow or non-hollow cylindrical supporting member 112 and a conductive elastic foam layer 113 disposed on the outer circumferential surface of the supporting member 112. The conductive elastic foam layer 113 is the outermost layer of the conductive roller 111.

The conductive roller according to the present exemplary embodiment is not limited to the structures in FIG. 1 and FIG. 2 and may have an intermediate layer between the supporting member 112 and the conductive elastic foam layer 113.

Figure 3A:
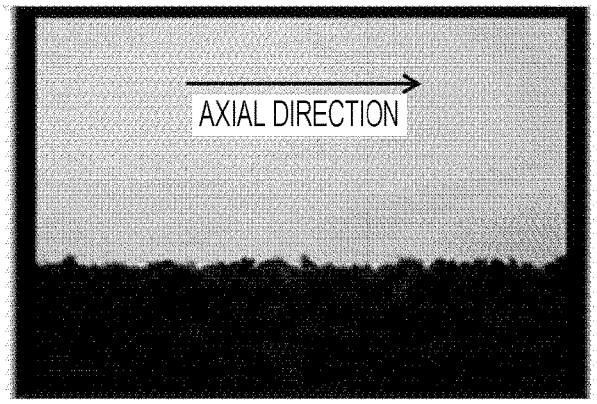
FIGS. 3A to 3C each illustrate an exemplary roughness waveform of the outer circumferential surface of the conductive elastic foam layer of the conductive roller according to the present exemplary embodiment.
Figure 3B:
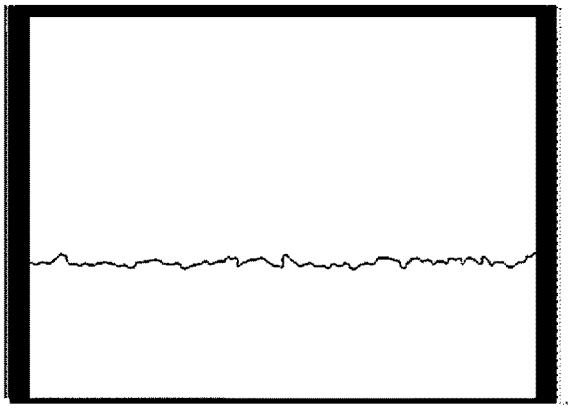
Figure 3C:
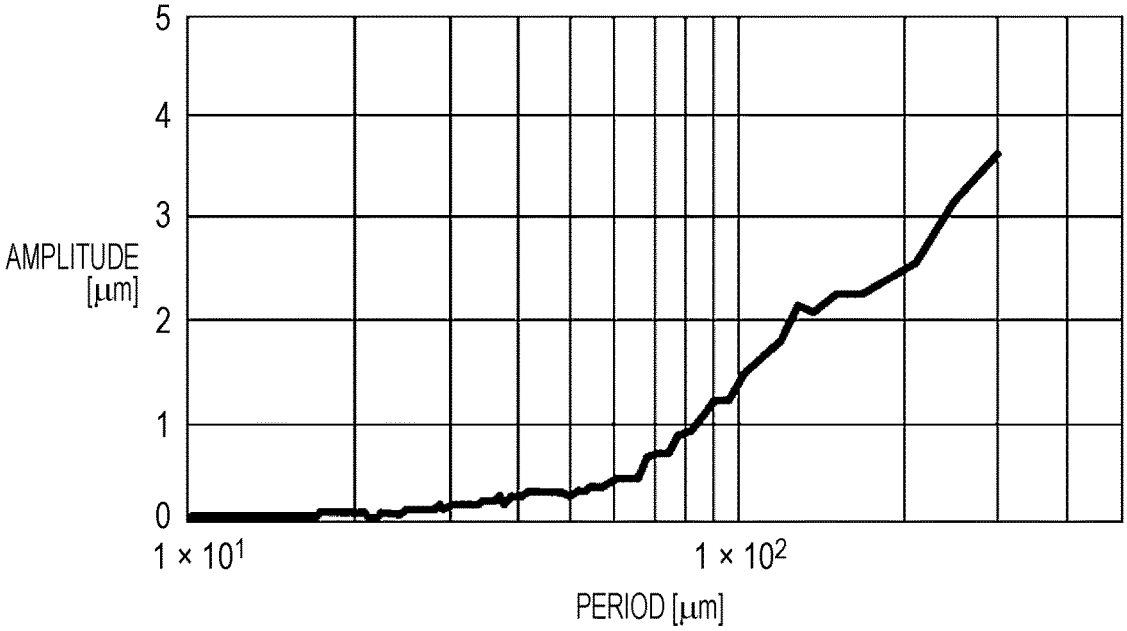

FIGS. 3A to 3C each illustrate an exemplary roughness waveform of the outer circumferential surface of the conductive elastic foam layer 113.

FIG. 3A is a micrograph of a profile of the outer circumferential surface of the conductive elastic foam layer 113. The micrograph in FIG. 3A is taken by using an optical microscope (e.g., KEYENCE CORPORATION, VHX-5000) at a resolution of 2 μm or less per pixel. The micrograph is taken from the side of the conductive roller 111 and at the height of the profile of the outer circumferential surface.

FIG. 3B is a roughness waveform based on the micrograph in FIG. 3A. A 1-mm section is taken from the roughness waveform in FIG. 3B in an axial direction and is subjected to two-dimensional discrete Fourier transform (2D-DFT) by using fast Fourier transformation (FFT) to obtain a spectrum of amplitude (μm) vs. period (μm).

FIG. 3C is a spectrum of the roughness waveform in FIG. 3B that is obtained by FFT. In the spectrum in FIG. 3C, the horizontal axis represents period, and the vertical axis represents amplitude. The spectrum uses a common logarithmic scale on the horizontal axis.

From the results of the FFT calculation, the integrated value (μm) of the amplitude (μm) within a period range of 100 μm or more and 300 μm or less is obtained. The integrated value is the sum of amplitudes (μm) discretized every 1 μm. Such integrated values of at least 20 portions (e.g., five portions in an axial direction in each of four portions in a circumferential direction (at 90° intervals)) are determined. The average of the at least 20 integrated values is calculated and regarded as the integrated value St.

From the spectrum in FIG. 3C, the amplitude of period 300 μm and the amplitude of period 100 μm are determined. As described above, the amplitude of period 300 μm and the amplitude of period 100 μm are determined in the at least 20 portions. The average of amplitudes of period 300 μm in the at least 20 portions is calculated and regarded as amplitude $A_{300}$ of period 300 μm. The average of amplitudes of period 100 μm in the at least 20 portions is calculated and regarded as amplitude $A_{100}$ of period 100 μm.

When a voltage is applied to the conductive roller 111 mounted on an electrophotographic image forming apparatus during formation of an image, unusual discharge may occur between the conductive roller 111 and a member facing the roller. For example, when the conductive roller 111 is used as a transfer roller, unusual discharge causes toner on a member facing the roller to be reversely discharged. As a result, transfer failure of the toner or scattering of the toner occurs, thereby causing density unevenness in images. On the other hand, in a case in which the integrated value St according to the conductive elastic foam layer 113 of the conductive roller 111 is 455 μm or less, when a voltage is applied, unusual discharge is unlikely to occur between the roller and a member facing the roller. The probable mechanism is as follows.

The outer circumferential surface of the conductive elastic foam layer 113, which is the outermost layer of the conductive roller 111, has been typically subjected to a polishing process. The profile of the outer circumferential surface of the conductive elastic foam layer 113 has a complex roughness waveform. The roughness waveform includes roughness components having different periods, such as a roughness component formed by a polish process, a roughness component derived from foamed cells of the conductive elastic foam layer 113, and a roughness component derived from particles dispersed in the conductive elastic foam layer 113.

The present inventors studied the roughness waveform by using fast Fourier transformation and found that a low amplitude of the roughness component within a period range of 100 μm or more and 300 μm or less suppresses occurrence of unusual discharge between the conductive roller 111 and a member facing the conductive roller 111. The electric field is likely to be concentrated in protrusions within a period range of 100 μm or more and 300 μm or less. The discharge may be provoked at such protrusions, and unusual discharge may occur between the conductive roller 111 and a member facing the conductive roller 111.

The present inventors studied further and found that when the integrated value St according to the conductive elastic foam layer 113 is 455 μm or less, unusual discharge is unlikely to occur between the conductive roller 111 and a member facing the conductive roller 111. For example, in a case where the conductive roller 111 is used as a transfer roller, when the integrated value St is 455 μm or less, occurrence of density unevenness of images is suppressed.

To suppress occurrence of unusual discharge between the conductive roller 111 and a member facing the conductive roller 111, the integrated value St is preferably lower, more preferably 410 μm or less, still more preferably 380 μm or less, still more preferably 350 μm or less, and still more preferably 320 μm or less.

It is difficult to eliminate all of several hundred micrometer-order roughness components from the outer circumferential surface of the conductive elastic foam layer 113, in which foamed cells are present. Thus, the lower limit of the integrated value St is, for example, 100 μm or more, 150 μm or more, or 200 μm or more.

There is a high correlation between the integrated value St and amplitude $A_{300}$ of period 300 μm. As amplitude $A_{300}$ increases, the integrated value St tends to increase. Amplitude $A_{300}$ of period 300 μm is preferably 3.6 μm or less, more preferably 3.0 μm or less, still more preferably 2.5 μm or less, and still more preferably 2.0 μm or less. The lower limit of amplitude $A_{300}$ of period 300 μm is not particularly limited and may be 1.5 μm or more.

To suppress unusual discharge between the conductive roller 111 and a member facing the conductive roller 111, amplitude $A_{300}$ of period 300 μm and amplitude $A_{100}$ of period 100 μm may have the following characteristics.

Amplitude $A_{300}$ of period 300 μm and amplitude $A_{100}$ of period 100 μm preferably satisfy $1 \leq A_{300}/A_{100} \leq 3$, more preferably $1 \leq A_{300}/A_{100} \leq 2.5$, and still more preferably $1 \leq A_{300}/A_{100} \leq 2$.

Amplitude $A_{100}$ of period 100 μm is preferably 2 μm or less, more preferably 1.5 μm or less, and still more preferably 1.2 μm or less. The lower limit of amplitude $A_{100}$ of period 100 μm is not particularly limited and may be 0.8 μm or more.

Hereinafter, the material of each layer forming the conductive roller according to the present exemplary embodiment will be described.

Supporting Member

The supporting member functions as a supporting member of the conductive roller mounted on an image forming apparatus and functions as an electrode during image formation. The supporting member may be a hollow member or a solid member.

The supporting member is a conductive member and may be a metal member made of a metal, such as iron (e.g., free-cutting steel), copper, brass, stainless steel, aluminum, or nickel; a resin member or ceramic member with an outer surface subjected to plating treatment; or a resin member or ceramic member containing a conductive agent.

Conductive Elastic Foam Layer

The conductive elastic foam layer is a foam body containing a rubber material (elastic material) and may contain a conductive agent or another additive.

Examples of the rubber material (elastic material) include isoprene rubber, chloroprene rubber, epichlorohydrin rubber, butyl rubber, polyurethane, silicone rubber, fluorine rubber, styrene-butadiene rubber, butadiene rubber, nitrile rubber, ethylenepropylene rubber, epichlorohydrin-ethylene oxide copolymer rubber, epichlorohydrin-ethylene oxide-allyl glycidyl ether terpolymer rubber, ethylene-propylene-diene terpolymer rubber (EPDM), acrylonitrile-butadiene copolymer rubber (NBR), natural rubber, and a mixture rubber in which the above compounds are mixed together.

Examples of the blowing agent that causes the elastic layer to foam include water; azo compounds, such as azodicarbonamide, azobisisobutyronitrile, and diazoaminobenzene; benzenesulfonyl hydrazides, such as benzenesulfonyl hydrazide, 4,4'-oxybisbenzenesulfonyl hydrazide, and toluenesulfonyl hydrazide; bicarbonate salts that generate carbon dioxide gas during thermal decomposition, such as sodium hydrogen carbonate; mixtures of $NaNO_2$ and $NH_4Cl$ that generate nitrogen gas; and peroxides that generate oxygen. Another agent, such as a foaming auxiliary agent, a foam stabilizer, or a catalyst may optionally be used.

A conductive agent is used when a rubber material has low conductivity or when a rubber material does not have conductivity. Examples of the conductive agent include electron-conductive agents and ion-conductive agents.

The electron-conductive agent may be a powder material. Examples of such a powder material include carbon black, such as KETJENBLACK and acetylene black; pyrolytic carbon; graphite; metals and metal alloys, such as aluminum, copper, nickel, and stainless steel; conductive metal oxides, such as tin oxide, indium oxide, titanium oxide, tin oxide-antimony oxide solid solution, and tin oxide-indium oxide solid solution; and insulating materials having a surface subjected to conductive treatment. Such electron-conductive agents may be used alone or in a combination of two or more.

Among such powder materials, the electron-conductive agent may be carbon black and preferably has an average primary particle size of 10 nm or more and 150 nm or less, more preferably 20 nm or more and 100 nm or less, and still more preferably 30 nm or more and 80 nm or less.

The amount of carbon black relative to 100 parts by mass of the rubber material is preferably 1 part by mass or more and 60 parts by mass or less and more preferably 10 parts by mass or more and 40 parts by mass or less.

Examples of the ion-conductive agent include quaternary ammonium salts (e.g., perchloric acid salts, chloric acid salts, fluoboric acid salts, sulfuric acid salts, ethosulfate salts, benzyl bromide salts, and benzyl chloride salts of lauryltrimethylammonium, stearyltrimethylammonium, octadodecyltrimethylammonium, dodecyltrimethylammonium, hexadecyltrimethylammonium, or modified-fatty acid-dimethylethylammonium), aliphatic sulfonic acid salts, higher alcohol sulfate salts, higher alcohol ethylene oxide adduct sulfate salts, higher alcohol phosphate salts, higher alcohol ethylene oxide adduct phosphate salts, betaines, higher alcohol ethylene oxides, polyethylene glycol fatty acid esters, and polyhydric alcohol fatty acid esters. Such ion-conductive agents may be used alone or in a combination of two or more.

The amount of ion-conductive agent relative to 100 parts by mass of the rubber material is preferably 0.1 parts by mass or more and 5.0 parts by mass or less and more preferably 0.5 parts by mass or more and 3.0 parts by mass or less.

Another additive may be a known material that can be added to elastic layers, such as a blowing agent, a foaming auxiliary agent, a softening agent, a plasticizer, a curing agent, a vulcanizing agent, a vulcanizing accelerator, an antioxidant, a surfactant, a coupling agent, or a filler (e.g., silica or calcium carbonate).

The conductive elastic foam layer may have a thickness of 1 mm or more and 20 mm or less and preferably 2 mm or more and 15 mm or less.

The hardness of the conductive elastic foam layer measured with Asker C-type hardness tester is preferably 20° or more and 70° or less and more preferably 30° or more and 60° or less, under a load of 1 kgf.

Method for Producing Conductive Roller

The conductive roller according to the present exemplary embodiment is obtained by disposing a conductive elastic foam layer on a supporting member. A method for disposing a conductive elastic foam layer on a supporting member is not particularly limited and may include preparing a cylindrical conductive elastic foam body and inserting a supporting member into the cylindrical conductive elastic foam body. The outer diameter of a conductive roller may be adjusted by polishing the outer circumferential surface of a conductive elastic foam layer disposed on a supporting member.

The method for producing the conductive roller according to the present exemplary embodiment desirably includes polishing the outer circumferential surface of a conductive elastic foam layer disposed on a supporting member (referred to as a "polishing step") and causing the polished outer circumferential surface of the conductive elastic foam layer to be in contact with a heating roller while rotating (referred to as a "surface heat treatment step"). Protrusions formed on the outer circumferential surface of a conductive elastic foam layer in the polishing step are made uniform in the surface heat treatment step, and thus, the amplitude of the roughness component within a period range of 100 μm or more and 300 μm or less of the outer circumferential surface of the conductive elastic foam layer is decreased.

The surface heat treatment step may include pressing a heated metal roller onto the polished outer circumferential surface of a conductive elastic foam layer and rotating a supporting member and the conductive elastic foam layer with the metal roller.

The amplitude and integrated value St of the roughness component within a period range of 100 μm or more and 300 μm or less of the outer circumferential surface of a conductive elastic foam layer can be controlled by adjusting the size of foamed cells of the conductive elastic foam layer or can be controlled in the polishing step or the surface heat treatment step, to which the outer circumferential surface of a conductive elastic foam layer is subjected.

The integrated value St tends to decrease as the diameter of the foamed cells of the conductive elastic form layer decreases. When a conductive roller having small foamed cells in the outer circumferential surface is used as a transfer roller, due to a small foamed cell diameter, the back surface of a recording medium (surface in contact with the transfer roller) may be smeared. Thus, the foamed cell diameter of the outer circumferential surface of a transfer roller may be large to some extent. The probable reason for this phenomenon is as follows. Residual toner on an image holder or an intermediate transfer body may transfer to a transfer roller. When the foamed cell diameter of the outer circumferential surface of the transfer roller is large to some extent, the toner is accommodated in the open foamed cells, thereby suppressing adhesion of the toner to the back surface of a recording medium on which an image is to be formed subsequently.

From the above viewpoint, the foamed cell diameter of the conductive elastic foam layer is preferably 30 μm or more and 300 μm or less, more preferably 40 μm or more and 280 μm or less, and still more preferably 50 μm or more and 250 μm or less.

The foamed cell diameter of a conductive elastic foam layer can be controlled by adjusting the amount of blowing agent contained in the base compound of the conductive elastic foam layer and/or adjusting the temperature and time for vulcanization-molding of the conductive elastic foam layer.

The method for measuring the foamed cell diameter of a conductive elastic foam layer is as follows.

A conductive elastic foam layer is cut with a razor to obtain a cross section in the thickness direction. The layer is cut at 90° intervals in a circumferential direction to obtain a total of four cross sections such that each cross section is parallel to the axial direction. An image of the center portion of each cross section in the axial direction is taken by using a laser microscope (KEYENCE CORPORATION, VK-X200). The image is analyzed with image analysis software (Media Cybernetics, Inc., Image-Pro Plus), and 100 foamed cells present across 2000 μm from 50 μm depth to 2050 μm depth are randomly selected. Then, the dimension of the major axis of the 100 foamed cells is measured, and the average of the 100 measurements is calculated. Furthermore, the average of the measurements in four cross sections is calculated and defined as the foamed cell diameter.

The integrated value St tends to decrease in accordance with any or all of a decrease in the surface roughness of a grinding stone used in the polishing step, an increase in the rotational speed of the grinding stone, an increase in the rotational speed of a workpiece, and a decrease in the traverse speed.

The grinding stone may be a cylindrical metal grinding stone having protrusions on the surface that are similar to needles of a kenzan flower frog. The protrusions may have a shape of a cone or a polygonal pyramid, such as a triangular pyramid or a quadrangular pyramid, and may have the same height.

When such a grinding stone is used, the rotational speed of the grinding stone may be 5000 rpm or higher, and the rotational speed of a workpiece may be 1000 rpm or higher. The traverse speed may be 500 mm/min or higher and 2500 mm/min or lower. Rpm is the abbreviation for revolutions per minute.

The integrated value St tends to decrease as the temperature in the surface heat treatment step rises. However, when the temperature of the surface heat treatment step is too high, the outer circumferential surface of a conductive elastic foam layer melts, and the surface hardness increases after curing. Thus, the temperature may be not too high.

From the above viewpoint, the temperature of a heating roller used in the surface heat treatment step is preferably 80° C. or higher and 180° C. or lower, more preferably 100° C. or higher and lower than 180° C., and still more preferably 120° C. or higher and lower than 180° C.

The rotational speed of a heating roller may be 2 rpm or higher and 60 rpm or lower, and the rotational speed of a workpiece may be 2 rpm or higher and 60 rpm or lower.

Image Forming Apparatus, Transfer Device, Process Cartridge

Figure 4:
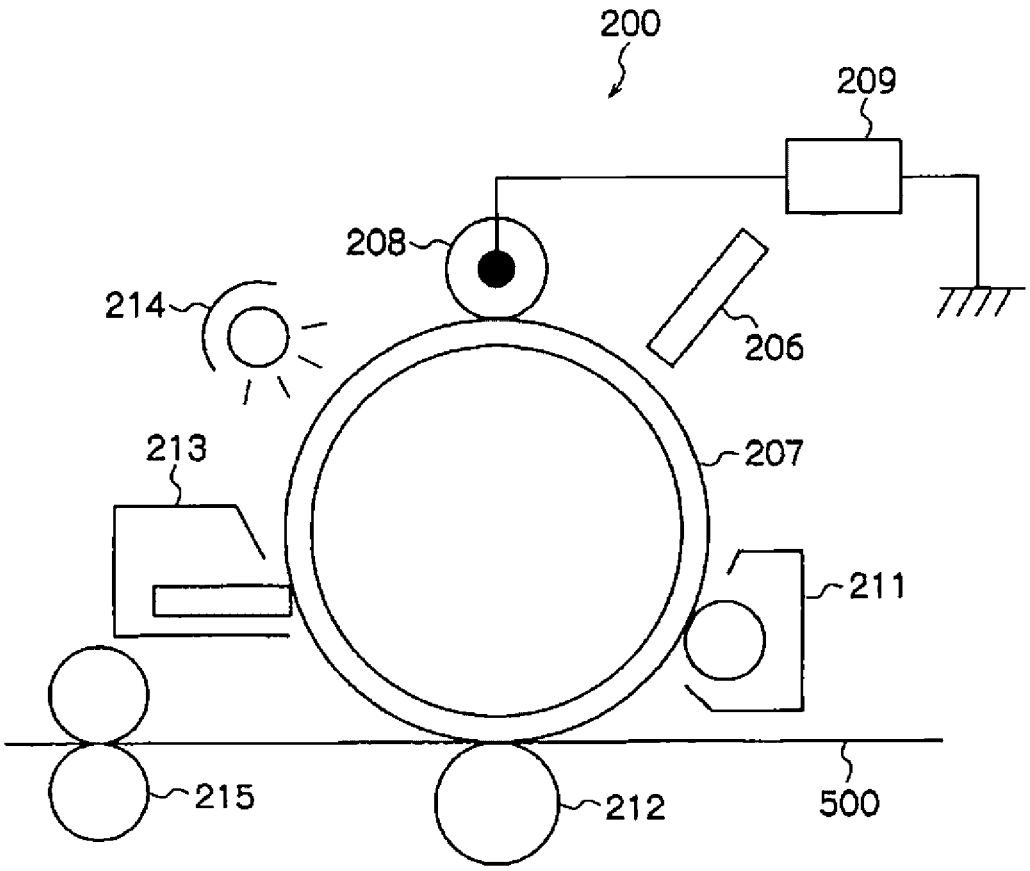
FIG. 4 is a schematic configuration diagram of an exemplary image forming apparatus according to the present exemplary embodiment.

FIG. 4 is a schematic configuration diagram of a direct-transfer-type image forming apparatus that is an exemplary image forming apparatus according to the present exemplary embodiment.

An image forming apparatus 200 illustrated in FIG. 4 includes a photoconductor 207 (exemplary image holder), a charging roller 208 (exemplary charging section) that charges the surface of the photoconductor 207, an exposure device 206 (exemplary electrostatic charge image forming section) that forms an electrostatic charge image on the charged surface of the photoconductor 207, a developing device 211 (exemplary developing section) that develops the electrostatic charge image formed on the surface of the photoconductor 207 into a toner image by using a developer containing toner, and a transfer roller 212 (exemplary transfer section, exemplary transfer device according to the present exemplary embodiment) that transfers the toner image formed on the surface of the photoconductor 207 to the surface of a recording medium. The conductive roller according to the present exemplary embodiment is used as the transfer roller 212.

The image forming apparatus 200 illustrated in FIG. 4 further includes a cleaning device 213 that removes residual toner on the surface of the photoconductor 207, a discharging device 214 that discharges the surface of the photoconductor 207, and a fixing device 215 (exemplary fixing section) that fixes the toner image on a recording medium.

The charging roller 208 may be a contact charging-type or a non-contact-charging type. A power source 209 applies a voltage to the charging roller 208.

The exposure device 206 may be an optical device including a light source, such as a semiconductor laser or a light emitting diode (LED).

The developing device 211 is a device that supplies toner to the photoconductor 207. For example, the developing device 211 moves a roller-shaped developer holder to cause the roller-shaped developer holder to be in contact with or to be close to the photoconductor 207 and attaches toner to an electrostatic charge image on the photoconductor 207 to form a toner image.

The transfer roller 212 is in direct contact with the surface of a recording medium and is disposed so as to face the photoconductor 207. A recording paper sheet 500 (exemplary recording medium) is supplied via a supplying mechanism to the nip between the transfer roller 212 and the photoconductor 207, which are in contact with each other. When a transfer bias is applied to the transfer roller 212, an electrostatic force from the photoconductor 207 to the recording paper sheet 500 is applied to the toner image, thereby transferring the toner image on the photoconductor 207 to the recording paper sheet 500.

The fixing device 215 may be a heat fixing device including a heating roller and a pressure roller that presses the heating roller.

The cleaning device 213 may be a device including a cleaning member, such as a blade, a brush, or a roller.

The discharging device 214 may be a device that irradiates the surface of the photoconductor 207 with light to discharge the residual potential of the photoconductor 207 after the transfer is performed.

For example, the photoconductor 207 and the transfer roller 212 may be integrated with each other in a single housing to form a cartridge structure (process cartridge according to the present exemplary embodiment) that is detachably attached to an image forming apparatus. Such a cartridge structure (process cartridge according to the present exemplary embodiment) may further include at least one selected from a group consisting of the charging roller 208, the exposure device 206, the developing device 211, and the cleaning device 213.

The image forming apparatus may be a tandem-type image forming apparatus including plural image forming units aligned therein that each include the photoconductor 207, the charging roller 208, the exposure device 206, the developing device 211, the transfer roller 212, and the cleaning device 213.

Figure 5:
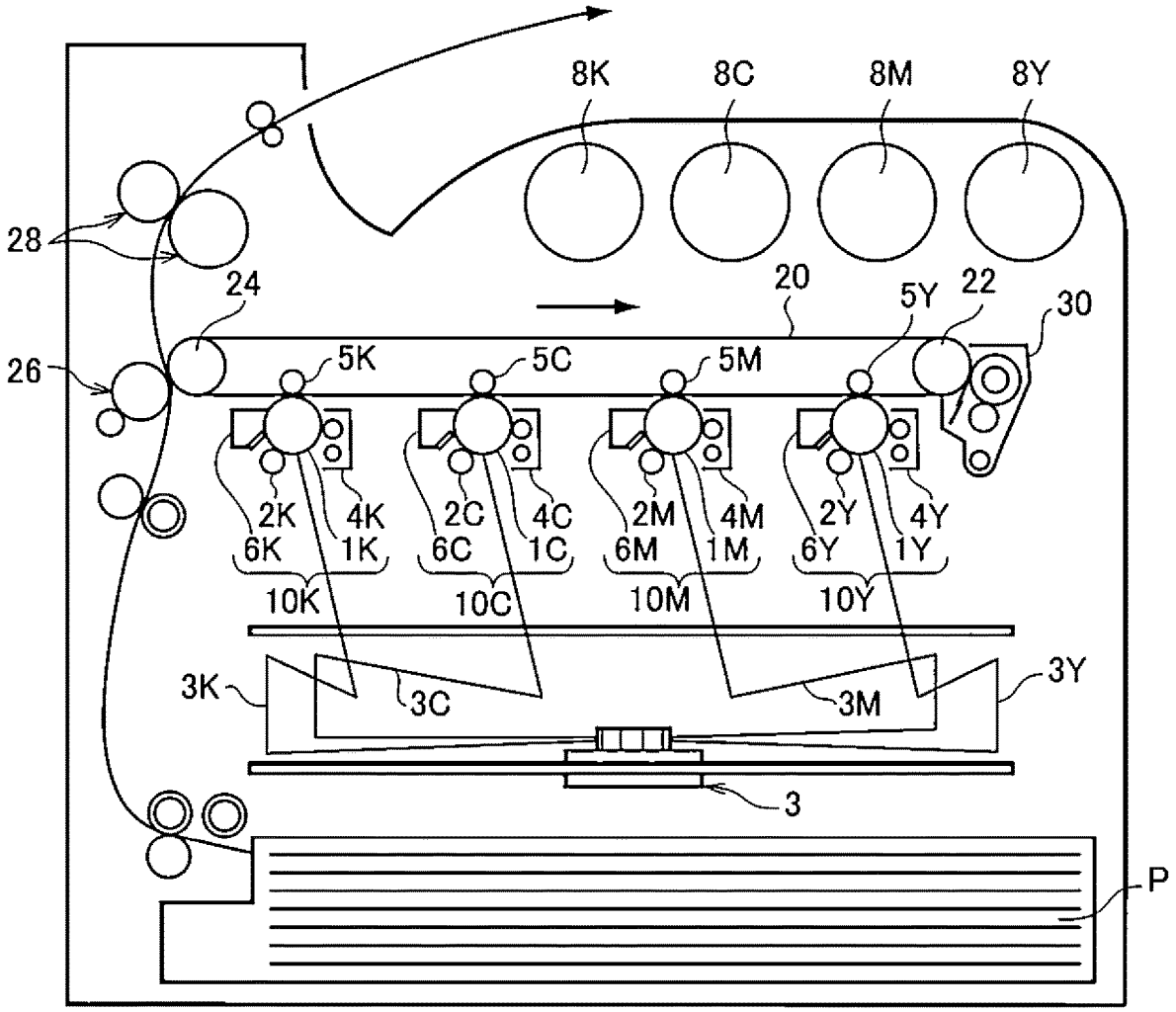
FIG. 5 is a schematic configuration diagram of another exemplary image forming apparatus according to the present exemplary embodiment.

FIG. 5 is a schematic configuration diagram of an intermediate-transfer-type image forming apparatus that is an exemplary image forming apparatus according to the present exemplary embodiment. The image forming apparatus illustrated in FIG. 5 is a tandem-type image forming apparatus in which four image forming units are arranged in parallel.

In the image forming apparatus illustrated in FIG. 5, a transfer section that transfers a toner image formed on the surface of an image holder to the surface of a recording medium is formed as a transfer unit (exemplary transfer device according to the present exemplary embodiment) including an intermediate transfer body, a primary transfer section, and a secondary transfer section. The transfer unit may be a cartridge structure detachably attached to an image forming apparatus.

The image forming apparatus illustrated in FIG. 5 includes photoconductors 1 (exemplary image holders), charging rollers 2 (exemplary charging sections) that charge the surfaces of the photoconductors 1, an exposure device 3 (exemplary electrostatic charge image forming section) that forms electrostatic charge images on the charged surfaces of the photoconductors 1, developing devices 4 (exemplary developing sections) that develop the electrostatic charge images formed on the surfaces of the photoconductors 1 into toner images by using developers containing toner, an intermediate transfer belt 20 (exemplary intermediate transfer body), primary transfer rollers 5 (exemplary primary transfer sections) that transfer the toner images formed on the surfaces of the photoconductors 1 to the surface of the intermediate transfer belt 20, and a secondary transfer roller 26 (exemplary secondary transfer section) that transfers the toner images that have been transferred to the surface of the intermediate transfer belt 20 to the surface of a recording medium. The conductive roller according to the present exemplary embodiment is used as at least one of the primary transfer rollers 5 and the secondary transfer roller 26.

The image forming apparatus illustrated in FIG. 5 further includes a fixing device 28 (exemplary fixing section) that fixes the toner image on a recording medium, a photoconductor cleaning device 6 that removes residual toner on the surface of the photoconductor 1, and an intermediate-transfer-belt cleaning device 30 that removes residual toner on the surface of the intermediate transfer belt 20.

The image forming apparatus illustrated in FIG. 5 includes first to fourth electrophotographic-type image forming units 10Y, 10M, 10C, and 10K that respectively output yellow (Y), magenta (M), cyan (C), and black (K) images on the basis of color-separated image data. Such image forming units 10Y, 10M, 10C, and 10K are disposed separately from each other in a horizontal direction in parallel. The image forming units 10Y, 10M, 10C, and 10K may each be a process cartridge detachably attached to an image forming apparatus.

Above the image forming units 10Y, 10M, 10C, and 10K, the intermediate transfer belt 20 extends through each image forming unit. The intermediate transfer belt 20 is disposed so as to go around a drive roller 22 and a support roller 24 such that the inner surface of the intermediate transfer belt 20 is in contact with such rollers, and runs in the direction from the first image forming unit 10Y to the fourth image forming unit 10K. For example, a spring not illustrated applies a force to the support roller 24 in a direction away from the drive roller 22, thereby applying tension to the intermediate transfer belt 20 that goes around both rollers. On the image holding surface side of the intermediate transfer belt 20, the intermediate-transfer-belt cleaning device 30 is disposed so as to face the drive roller 22.

Yellow, magenta, cyan, and black toners accommodated in toner cartridges 8Y, 8M, 8C, and 8K are respectively supplied to developing devices 4Y, 4M, 4C, and 4K of the image forming units 10Y, 10M, 10C, and 10K.

The first to fourth image forming units 10Y, 10M, 10C, and 10K have the same structure and operate in the same manner. Thus, hereinafter, in the description of the image forming unit, the first image forming unit 10Y will be described as a typical example.

The first image forming unit 10Y includes a photoconductor 1Y, a charging roller 2Y that charges the surface of the photoconductor 1Y, the developing device 4Y that develops an electrostatic charge image formed on the surface of the photoconductor 1Y into a toner image by using a developer containing toner, a primary transfer roller 5Y that transfers the toner image formed on the surface of the photoconductor 1Y to the surface of the intermediate transfer belt 20, and a photoconductor cleaning device 6Y that removes residual toner on the surface of the photoconductor 1Y after the primary transfer.

The charging roller 2Y charges the surface of the photoconductor 1Y. The charging roller 2Y may be a contact charging-type or a non-contact-charging type.

The exposure device 3 irradiates the charged surface of the photoconductor 1Y with a laser beam 3Y. This forms the yellow image pattern of an electrostatic charge image on the surface of the photoconductor 1Y.

For example, an electrostatic-charge-image developer containing at least yellow toner and a carrier is accommodated in the developing device 4Y. The yellow toner is stirred in the developing device 4Y and is thus frictionally charged. The surface of the photoconductor 1Y passes through the developing device 4Y, and thus, the electrostatic charge image formed on the photoconductor 1Y is developed into a toner image.

The primary transfer roller 5Y is disposed inward of the intermediate transfer belt 20 so as to face the photoconductor 1Y. The primary transfer roller 5Y is connected to a bias power source (not illustrated) that applies a primary transfer bias. The primary transfer roller 5Y transfers a toner image on the photoconductor 1Y to the intermediate transfer belt 20 by using an electrostatic force.

Toner images having different colors are transferred to overlap each other from the respective first to fourth image forming units 10Y, 10M, 10C, and 10K to the intermediate transfer belt 20. The intermediate transfer belt 20 to which four-color toner images are transferred to overlap each other from the respective first to fourth image forming units moves toward a secondary transfer unit including the support roller 24 and the secondary transfer roller 26.

The secondary transfer roller 26 is in direct contact with the surface of a recording medium and is disposed outward of the intermediate transfer belt 20 so as to face the support roller 24. A recording paper sheet P (exemplary recording medium) is supplied via a supplying mechanism to the nip between the secondary transfer roller 26 and the intermediate transfer belt 20, which are in contact with each other. When a secondary transfer bias is applied to the secondary transfer roller 26, an electrostatic force from the intermediate transfer belt 20 to the recording paper sheet P is applied to the toner image, thereby transferring the toner image on the intermediate transfer belt 20 to the recording paper sheet P.

The recording paper sheet P to which the toner image has been transferred is transported to the contact portion (nip) of the fixing device 28 including a pair of rollers. Then, the toner image is fixed on the recording paper sheet P.

A developer and toner used in the image forming apparatus according to the present exemplary embodiment are not particularly limited, and a known developer and toner for electrophotographic images can be used. Recording media used for the image forming apparatus according to the present exemplary embodiment are not particularly limited. Examples of the recording media include paper sheets used for electrophotographic-type copiers and printers and OHP sheets.

EXAMPLES

Hereinafter, exemplary embodiments of the disclosure will be described in detail with reference to Examples. The exemplary embodiments of the disclosure are not limited to Examples.

Measurement Method, Evaluation Method

Measurement methods and evaluation methods that are used for Examples and Comparative Examples are as follows.

Calculation of Integrated Value St

An image of the profile is taken by using an optical microscope (e.g., KEYENCE CORPORATION, VHX-5000) at a resolution of 2 μm or less per pixel. The image is taken from the side of the conductive roller and at the height of the profile of the outer circumferential surface of the conductive elastic foam layer. An image is taken in 20 portions such as in five portions in an axial direction (center, portions 50 mm away from the center, portions 100 mm away from the center) in each of four portions (at 90° intervals) in a circumferential direction.

The profile is image-analyzed by using analysis software (ImageJ) to extract a roughness waveform.

The roughness waveform of a 1-mm section in an axial direction is subjected to fast Fourier transformation to obtain a spectrum. The integrated value (μm) of the amplitude (μm) within a period range of 100 μm to 300 μm, the amplitude (μm) of period 300 μm, and the amplitude (μm) of period 100 μm are obtained in each of 20 portions, and the averages thereof are calculated. Analysis software (ImageJ) is used for fast Fourier transformation and spectrum analysis.

Measurement of Foamed Cell Diameter

A conductive elastic foam layer is cut with a razor to obtain a cross section in the thickness direction. The layer is cut at 90° intervals in a circumferential direction to obtain a total of four cross sections such that each cross section is parallel to the axial direction. An image of the center portion of each cross section in the axial direction is taken by using a laser microscope (KEYENCE CORPORATION, VK-X200). The image is analyzed with image analysis software (Media Cybernetics, Inc., Image-Pro Plus), and 100 foamed cells present across 2000 μm from 50 μm depth to 2050 μm depth are randomly selected. Then, the dimension of the major axis of the 100 foamed cells is measured, and the average of the 100 measurements is calculated. Furthermore, the average of the measurements in four cross sections is calculated and defined as the foamed cell diameter.

Evaluation of Density Unevenness

A conductive roller is installed as a transfer roller in DocuPrint CP400d (manufactured by Fuji Xerox Co., Ltd.), which is a direct-transfer-type image forming apparatus. A solid image having an image density of 100% is output to 10 A4-size paper sheets in an environment of a temperature of 10° C. and a relative humidity of 15%. All the sheets are observed and classified in accordance with the following criteria of density unevenness.

$A^+$ (E): Excellent image quality without density unevenness

A (G): Good image quality with substantially no density unevenness

B (F): Fair image quality with density unevenness

C (P): Poor image quality with unacceptable density unevenness

Evaluation of Smear on Back Surface

A halftone image having an image density of 50% is output to 180 A4-size paper sheets, and thereafter, a solid image having an image density of 100% is output to 20 A4-size paper sheets, by using the above image forming apparatus in an environment of a temperature of 28° C. and a relative humidity of 85%. This cycle is repeated 25 times (total of 5000 sheets output). The back surfaces (surface with no images) of 10 sheets from the 4991st sheet to the 5000th sheet are observed and classified in accordance with the following criteria of smear.

A (G): No problem in practical use although smear is slightly observed

B (F): Allowable although smear is observed

C (P): Unallowable smear is observed

Example 1

Formation of Conductive Elastic Foam Layer rubber material (epichlorohydrin-ethylene oxide-allyl glycidyl ether copolymer rubber: CG102 manufactured by OSAKA SODA CO., LTD.: 60%, acrylonitrile-butadiene rubber: N230SV manufactured by JSR CORPORATION: 40%) 100 parts by mass carbon black (#55, manufactured by Asahi Carbon Co., Ltd.) 15 parts by mass vulcanizing agent (sulfur) (200 mesh, manufactured by Tsurumi Chemical Industry Co., ltd.) 1 part by mass vulcanizing accelerator (NOCCELER DM, manufactured by OUCHI SHINKO CHEMICAL INDUSTRIAL CO., LTD) 1.5 parts by mass vulcanizing accelerator (NOCCELER TET, manufactured by OUCHI SHINKO CHEMICAL INDUSTRIAL CO., LTD) 1.0 part by mass zinc oxide (Zinc Oxide Type 1, manufactured by SEIDO CHEMICAL INDUSTRY CO., LTD.) 5 parts by mass calcium carbonate (WHITON SSB, manufactured by Shiraishi Calcium Kaisha, Ltd.) 10 parts by mass stearic acid (Stearic Acid S, manufactured by Kao Corporation) 1 part by mass blowing agent (NEOCELLBORN N#5000, manufactured by EIWA CHEMICAL IND. CO., LTD) appropriate amount (amount to obtain a desired foamed cell diameter)

The above materials are kneaded together with open rollers to obtain a rubber kneaded material A. The rubber kneaded material A is extruded to form a cylindrical shape with an outer diameter of 19 mm and an inner diameter of 5.6 mm and is heated at 160° C. for 30 minutes, vulcanized, and foamed to obtain a cylindrical conductive elastic foam body. A shaft (made of SUS, diameter 6 mm) is inserted into the cylindrical conductive elastic foam body. At a grinding stone rotational speed of 7000 rpm, a workpiece rotational speed of 1500 rpm, and a traverse speed of 1500 mm/min, the outer circumferential surface of the conductive elastic foam body is polished with a rubber polishing machine in which a cylindrical metal grinding stone (grit F60) having protrusions similar to needles of a kenzan flower flog is installed. In such a manner, a conductive roller 1 including a conductive elastic foam layer with an outer diameter of 16 mm and a length of 224 mm is obtained.

Example 2

A conductive roller 2 is obtained in the same manner as in Example 1, except that heating is performed at 145° C. for 40 minutes, that the grinding stone rotational speed is changed to 6000 rpm, and that the traverse speed is changed to 2000 mm/min.

Example 3

A conductive roller 3 is obtained in the same manner as in Example 1, except that heating is performed at 135° C. for 50 minutes, that the grinding stone rotational speed is changed to 5000 rpm, and that the traverse speed is changed to 2500 mm/min.

Example 4

A conductive roller 4 is obtained in the same manner as in Example 1, except that heating is performed at 185° C. for 20 minutes.

Example 5

A conductive roller 5 is obtained in the same manner as in Example 1, except that heating is performed at 175° C. for 20 minutes.

Comparative Example 1

A conductive roller 6 is obtained in the same manner as in Example 1, except that heating is performed at 130° C. for 60 minutes, that the grit number of the grinding stone is changed to grit F40, that the grinding stone rotational speed is changed to 4000 rpm, and that the traverse speed is changed to 3000 mm/min.

Comparative Example 2

A conductive roller 7 is obtained in the same manner as in Comparative Example 1, except that heating is performed at 190° C. for 15 minutes.

TABLE 1

| | Example 1 | Example 2 | Example 3 | Example 4 | Example 5 | Comparative Example 1 | Comparative Example 2 |
|---|---|---|---|---|---|---|---|
| Integrated value St (μm) | 380 | 409 | 455 | 332 | 358 | 491 | 472 |
| Amplitude $A_{300}$ (μm) | 2.75 | 3.00 | 3.60 | 2.58 | 2.55 | 4.21 | 3.95 |
| Amplitude $A_{100}$ (μm) | 1.10 | 1.21 | 1.20 | 1.09 | 1.07 | 1.28 | 1.19 |
| $A_{300}/A_{100}$ | 2.50 | 2.48 | 3.00 | 2.37 | 2.38 | 3.29 | 3.32 |
| Foamed cell diameter (μm) | 100 | 250 | 300 | 30 | 50 | 340 | 25 |
| Density unevenness | A (G) | A (G) | B (F) | A (G) | A (G) | C (P) | C (P) |
| Smear on back surface | A (G) | A (G) | A (G) | B (F) | A (G) | A (G) | C (P) |

Example 11

Formation of Conductive Elastic Foam Layer rubber material (epichlorohydrin-ethylene oxide-allyl glycidyl ether copolymer rubber: CG102 manufactured by OSAKA SODA CO., LTD.: 60%, acrylonitrile-butadiene rubber: N230SV manufactured by JSR CORPORATION: 40%) 100 parts by mass carbon black (#55, manufactured by Asahi Carbon Co., Ltd.) 15 parts by mass vulcanizing agent (sulfur) (200 mesh, manufactured by Tsurumi Chemical Industry Co., ltd.) 1 part by mass vulcanizing accelerator (NOCCELER DM, manufactured by OUCHI SHINKO CHEMICAL INDUSTRIAL CO., LTD) 1.5 parts by mass vulcanizing accelerator (NOCCELER TET, manufactured by OUCHI SHINKO CHEMICAL INDUSTRIAL CO., LTD) 1.0 part by mass zinc oxide (Zinc Oxide Type 1, manufactured by SEIDO CHEMICAL INDUSTRY CO., LTD.) 5 parts by mass calcium carbonate (WHITON SSB, manufactured by Shiraishi Calcium Kaisha, Ltd.) 10 parts by mass stearic acid (Stearic Acid S, manufactured by Kao Corporation) 1 part by mass blowing agent (NEOCELLBORN N#5000, manufactured by EIWA CHEMICAL IND. CO., LTD) 5 parts by mass The above materials are kneaded together with open rollers to obtain a rubber kneaded material B. The rubber kneaded material B is extruded to form a cylindrical shape with an outer diameter of 19 mm and an inner diameter of 5.6 mm and is heated at 160° C. for 30 minutes, vulcanized, and foamed to obtain a cylindrical conductive elastic foam body. A shaft (made of SUS, diameter 6 mm) is inserted into the cylindrical conductive elastic foam body. At a grinding stone rotational speed of 7000 rpm, a workpiece rotational speed of 1500 rpm, and a traverse speed of 1500 mm/min, the outer circumferential surface of the conductive elastic foam body is polished to have an outer diameter of 16 mm by using a rubber polishing machine in which a cylindrical metal grinding stone (grit F60) having protrusions similar to needles of a kenzan flower flog is installed.

Next, a metal roller (made of SUS, diameter 32 mm) having a temperature of 120° C. is pressed into the outer circumferential surface of the polished conductive elastic foam body to a depth of 0.8 mm and rotated for 90 seconds while being in contact with the conductive elastic foam body, at a metal roller rotational speed of 10 rpm and a workpiece rotational speed of 10 rpm.

In such a manner, a conductive roller 11 including a conductive elastic foam layer with an outer diameter of 16 mm and a length of 224 mm is obtained.

Example 12

A conductive roller 12 is obtained in the same manner as in Example 11, except that the grinding stone rotational speed is changed to 6000 rpm and that the traverse speed is changed to 2000 mm/min.

Example 13

A conductive roller 13 is obtained in the same manner as in Example 11, except that the grinding stone rotational speed is changed to 5000 rpm and that the traverse speed is changed to 2500 mm/min.

Example 14

A conductive roller 14 is obtained in the same manner as in Example 11, except that the temperature of the metal roller is changed to 80° C.

Example 15

A conductive roller 15 is obtained in the same manner as in Example 11, except that the temperature of the metal roller is changed to 160° C.

Example 16

A conductive roller 16 is obtained in the same manner as in Example 11, except that the temperature of the metal roller is changed to 180° C.

Example 17

A conductive roller 17 is obtained in the same manner as in Example 11, except that the grit number of the grinding stone is changed to grit F40, that the grinding stone rotational speed is changed to 4000 rpm, that the traverse speed is changed to 3000 mm/min, and that the temperature of the metal roller is changed to 80° C.

Comparative Example 11

A conductive roller 18 is obtained in the same manner as in Example 17, except that the temperature of the metal roller is changed to 60° C.

Comparative Example 12

A conductive roller 19 is obtained in the same manner as in Example 17, except that surface heat treatment using the metal roller is not performed.

TABLE 2

| | Example 11 | Example 12 | Example 13 | Example 14 | Example 15 | Example 16 | Example 17 | Comparative Example 11 | Comparative Example 12 |
|---|---|---|---|---|---|---|---|---|---|
| Integrated value St (μm) | 248 | 353 | 411 | 376 | 214 | 210 | 455 | 466 | 491 |
| Amplitude $A_{300}$ (μm) | 1.83 | 2.62 | 3.10 | 2.72 | 1.61 | 1.57 | 3.59 | 3.81 | 4.32 |
| Amplitude $A_{100}$ (μm) | 1.06 | 1.09 | 1.15 | 1.09 | 1.02 | 1.01 | 1.21 | 1.22 | 1.23 |
| $A_{300}/A_{100}$ | 1.73 | 2.40 | 2.70 | 2.50 | 1.58 | 1.55 | 2.97 | 3.12 | 3.51 |
| Density unevenness | $A^+$ (E) | A (G) | B (F) | A (G) | $A^+$ (E) | $A^+$ (E) | B (F) | C (P) | C (P) |

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A conductive roller comprising:

a supporting member; and a conductive elastic foam layer disposed on the supporting member, wherein, in a spectrum of amplitude (μm) vs. period (μm) obtained by subjecting a roughness waveform of an outer circumferential surface of the conductive elastic foam layer in an axial direction to fast Fourier transformation, an integrated value St of an amplitude within a period range of 100 μm or more and 300 μm or less is 455 μm or less.

2. The conductive roller according to claim 1, wherein the integrated value St is 410 μm or less.

3. A conductive roller comprising:

a supporting member; and a conductive elastic foam layer disposed on the supporting member, wherein, in a spectrum of amplitude (μm) vs. period (μm) obtained by subjecting a roughness waveform of an outer circumferential surface of the conductive elastic foam layer in an axial direction to fast Fourier transformation, amplitude $A_{300}$ of period 300 μm is 3.6 μm or less.

4. The conductive roller according to claim 3, wherein the amplitude $A_{300}$ is 3.0 μm or less.

5. The conductive roller according to claim 1, wherein, in the spectrum of amplitude (μm) vs. period (μm) obtained by subjecting the roughness waveform of the outer circumferential surface of the conductive elastic foam layer in the axial direction to fast Fourier transformation, a ratio $A_{300}/A_{100}$ of amplitude $A_{300}$ of period 300 μm to amplitude $A_{100}$ of period 100 μm is 1 or higher and 3 or lower.

6. The conductive roller according to claim 2, wherein, in the spectrum of amplitude (μm) vs. period (μm) obtained by subjecting the roughness waveform of the outer circumferential surface of the conductive elastic foam layer in the axial direction to fast Fourier transformation, a ratio $A_{300}/A_{100}$ of amplitude $A_{300}$ of period 300 μm to amplitude $A_{100}$ of period 100 μm is 1 or higher and 3 or lower.

7. The conductive roller according to claim 3, wherein, in the spectrum of amplitude (μm) vs. period (μm) obtained by subjecting the roughness waveform of the outer circumferential surface of the conductive elastic foam layer in the axial direction to fast Fourier transformation, a ratio $A_{300}/A_{100}$ of amplitude $A_{300}$ of period 300 μm to amplitude $A_{100}$ of period 100 μm is 1 or higher and 3 or lower.

8. The conductive roller according to claim 4, wherein, in the spectrum of amplitude (μm) vs. period (μm) obtained by subjecting the roughness waveform of the outer circumferential surface of the conductive elastic foam layer in the axial direction to fast Fourier transformation, a ratio $A_{300}/A_{100}$ of amplitude $A_{300}$ of period 300 μm to amplitude $A_{100}$ of period 100 μm is 1 or higher and 3 or lower.

9. The conductive roller according to claim 5, wherein the ratio $A_{300}/A_{100}$ is 1 or higher and 2.5 or lower.

10. The conductive roller according to claim 6, wherein the ratio $A_{300}/A_{100}$ is 1 or higher and 2.5 or lower.

11. The conductive roller according to claim 7, wherein the ratio $A_{300}/A_{100}$ is 1 or higher and 2.5 or lower.

12. The conductive roller according to claim 8, wherein the ratio $A_{300}/A_{100}$ is 1 or higher and 2.5 or lower.

13. A method for producing the conductive roller according to claim 1, the method comprising:

polishing an outer circumferential surface of a conductive elastic foam layer disposed on a supporting member; and causing the polished outer circumferential surface of the conductive elastic foam layer to be in contact with a heating roller while rotating.

14. A transfer device comprising the conductive roller according to claim 1.

15. A process cartridge comprising: an image holder and the transfer device according to claim 14, wherein the process cartridge is detachably attached to an image forming apparatus.

16. An image forming apparatus comprising:

an image holder;

a charging section that charges a surface of the image holder;

an electrostatic charge image forming section that forms an electrostatic charge image on the charged surface of the image holder;

a developing section that develops the electrostatic charge image formed on the surface of the image holder into a toner image by using a developer containing toner; and a transfer section including the conductive roller according to claim 1 that transfers the toner image to a surface of a recording medium.

* * * * *